US010478948B2

(12) United States Patent
Nguyen

(10) Patent No.: US 10,478,948 B2
(45) Date of Patent: Nov. 19, 2019

(54) DEVICES AND METHODS FOR INSTALLING NETWORK HARDWARE IN SERVER RACKS

(71) Applicant: DKNXT, Inc., Houston, TX (US)

(72) Inventor: Thai-Binh Nguyen, Houston, TX (US)

(73) Assignee: DKNXT, Inc., Houston, TX (US)

( * ) Notice: Subject to any disclaimer, the term of this patent is extended or adjusted under 35 U.S.C. 154(b) by 167 days.

(21) Appl. No.: 15/807,748

(22) Filed: Nov. 9, 2017

(65) Prior Publication Data

US 2019/0134786 A1 May 9, 2019

(51) Int. Cl.
*B25B 9/00* (2006.01)
*B25B 11/02* (2006.01)

(52) U.S. Cl.
CPC ..... *B25B 11/02* (2013.01); *B25B 9/00* (2013.01)

(58) Field of Classification Search
CPC ..... B25B 11/00; B25B 11/02; B25B 3/00; B25B 5/00
See application file for complete search history.

(56) References Cited

U.S. PATENT DOCUMENTS 7,661,173 B2 * 2/2010 Amos ..... B08B 1/00 134/6
10,257,962 B2 * 4/2019 Harris ..... H05K 7/20418
2013/0033269 A1 * 2/2013 He ..... G01R 31/07 324/550
2019/0134786 A1 * 5/2019 Nguyen ..... B25B 9/00

FOREIGN PATENT DOCUMENTS

DE 102009038160 A1 2/2010
JP 2010129058 A 6/2010

OTHER PUBLICATIONS

Kendall Howard 2U Rack Helper #1924-1-001-02, Available at http://www.kendallhoward.com/Rack-Helper.html (last accessed Nov. 8, 2017).

* cited by examiner

*Primary Examiner* — Lee D Wilson
(74) *Attorney, Agent, or Firm* — Beem Patent Law Firm

(57) ABSTRACT

Tools for installing network hardware in server racks may self-adhere to a server rack, alleviating the need for cap screws to attach the tool to the rack. The tool also may support the weight and aid alignment of the network hardware in a rack unit during installation. In some embodiments, the tool may include one or more spring-loaded locks adapted to couple to corresponding holes in the rack. The network device may rest atop the tool so that the network device is properly aligned for installation in the rack unit above the tool. In operation, a technician may couple one or more tools to the rack in the slot below the intended rack unit for the network device to provide hands-free support of the weight of the network device. The technician may then use both hands to screw the network device to the rack.

20 Claims, 5 Drawing Sheets

DEVICES AND METHODS FOR INSTALLING NETWORK HARDWARE IN SERVER RACKS

BACKGROUND OF THE INVENTION

1. Technical Field

This application is directed to the field of installing network hardware in server racks, and more particularly to devices that support at least a portion of the weight of a network device during its installation in a server rack.

2. Related Art

Designers of servers and heavy rack-mountable devices usually have their equipment sent with rack rails or they can be ordered as an option for rack posts or cabinets that have square holes in accordance with the Electronic Industries Association's EAI-310 standards. However, lighter equipment, such as devices that are about 20 lbs. or less, may be directly screwed to the rack posts with the use of cage nuts. This equipment—including firewalls, switches, routers, rack trays, KVM (Keyboard, Video and Mouse) equipment, and the like—are rarely provided with any type of fitted or custom railings.

Although the installation process for these types of devices is relatively straightforward, it is not without its difficulties. Typically, a second person is needed to hold the device while an installer screws in the screws to fasten the network device to the rack. Even the lightest of the network equipment require some form of bodily rigging to hold up the device while lining up a screw to have it then screwed into the rack post—it is difficult to hold a 20 lb. unit in place while positioning a screw into the cage nut and then pulling out the screw driver to screw the unit in on each ear.

To further complicate the installation process, networking equipment is typically installed at data centers that are remote or away from a location where help can be easily requested. In some cases, installation and setups are done after normal business hours to minimize disruptions, further reducing the likelihood that manual assistance is available. Thus, when installing a device, installers tend to either schedule another technician or have to install something lighter underneath the device's intended position to provide support so that the intended device can be installed. This lighter device must then be removed from the rack after installation on the intended device is complete.

Accordingly, a need has long existed for devices that facilitate the installation of a network equipment on a rack.

SUMMARY

Tools for installing network hardware in server racks may self-adhere to a server rack, alleviating the need for cap screws to attach the tool to the rack. The tool also may support the weight and aid alignment of the network hardware in a rack unit during installation. In some embodiments, the tool may include one or more spring-loaded locks adapted to couple to corresponding holes in the rack. The network device may rest atop the tool so that the network device is properly aligned for installation in the rack unit above the tool. In operation, a technician may couple one or more tools to the rack in the rack unit below the intended rack unit for the network device to provide hands-free support of the weight of the network device. The technician may then use both hands to screw the network device to the rack. Other features also are described.

Other systems, methods, features, and technical advantages of the invention will be, or will become apparent to one with skill in the art upon examination of the following figures and detailed description. It is intended that all such additional systems, methods, features, and technical advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION OF THE PREFERRED EMBODIMENTS

Figure 2A:
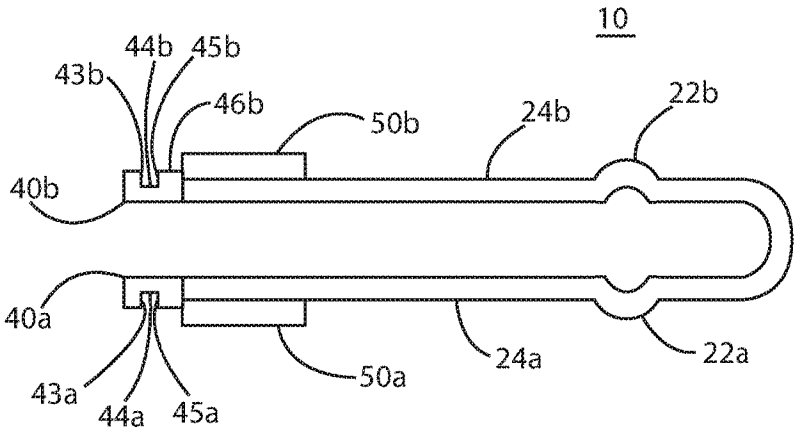
FIG. 2*a* shows a bottom view of the exemplary network device installation tool of FIG. 1.

The elements illustrated in the figures interoperate as explained in more detail below. Before setting forth the detailed explanation, however, it is noted that all of the discussion below, regardless of the particular implementation being described, is exemplary in nature, rather than limiting.

1.0 Network Device Installation Tool Overview

Referring to the drawings, and initially to FIGS. 1-4, various views of an exemplary network device installation tool 10 are shown. In the illustrated embodiment, the tool 10 may include a body 20, one or more upper tool lip locks 30*a* and 30*b*, one or more lower tool lip locks 40*a* and 40*b*, and one or more device tilt locks 50*a* and 50*b*.

The various components of the tool 10 may be made of any suitably hard materials, such as plastic, metal, carbon fiber and the like. Other materials also may be used. In some embodiments, each component is made of the same material. Alternatively or additionally, one or more of the components of the tool 10 may be made of different material than others of the components.

In operation, the body 20 may be compressed so that the upper tool lip locks 30*a* and 30*b* and the lower lip locks 40*a* and 40*b* come together and may be inserted into the square holes of a network rack below the designated rack unit for the network device to be installed. A conventional rack unit is defined by the EIA 310 standard, which specifies that a rack unit includes three square apertures that are 0.375 inch by 0.375 inch spaced off center-to-center by 0.625 inch with the sets spaced by 0.5 inch center-to-center from apertures of an adjacent rack unit. As a result, a single technician may install a network device without the need for additional assistance from a second technician. In addition, because there is no installation process of another piece of full 19" rack hardware and/or nothing to screw into the rack, the tool 10 allows a technician to quickly clip the tool 10 on each ear of the network device to hold the network device in place, freeing the technician's hand to then secure the network device to the rack using screws and cage nuts.

Each tool 10 that is attached to a rack may support a portion of the weight of the network device to be installed and more than one tool 10 may be required to fully support the weight of the network device. The material used to construct the tool 10 may correlate to the tool's 10 ability to support a given weight. For example, most switches, routers, firewalls, KVM switches and other light-weight 1 U to 2 U network devices or cabinet accessories (such as trays and spacers) require only two plastic tools 10 (one on each side) to fully support the device during rack installation. For heavier equipment, three or four tools 10, such as one in each rack corner, may be necessary to fully support the network device during installation.

Tools 10 may be made of different materials to provide different weight support capabilities. For example, in some embodiments, plastic versions of the tool 10 may assist with the installation of network devices weighing up to about 40 lbs. Other materials, such as metals and the like, may be able to support heavier weights.

1.1 Exemplary Bodies 20

Figure 2B:
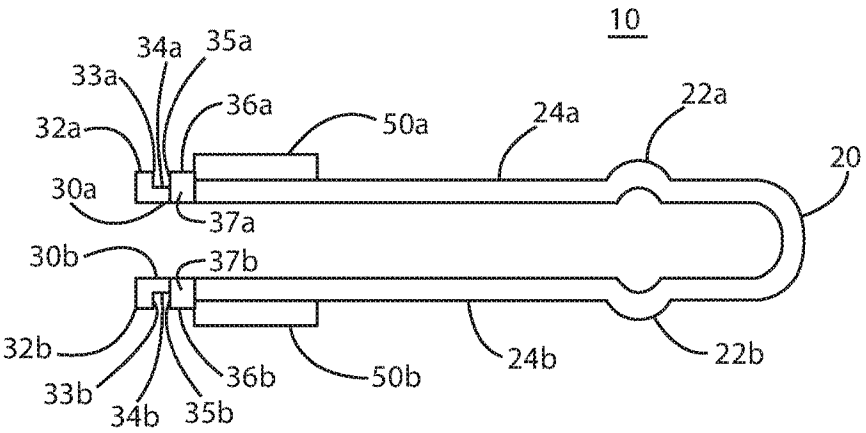
FIG. 2*b* shows a top view of the exemplary network device installation tool of FIG. 1.
Figure 1:
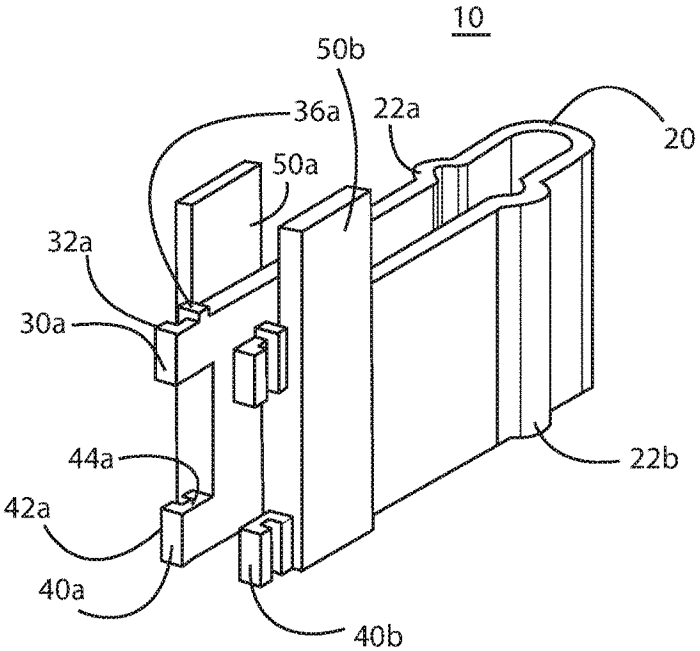
FIG. 1 shows a perspective view of an exemplary network device installation tool.
Figure 4:
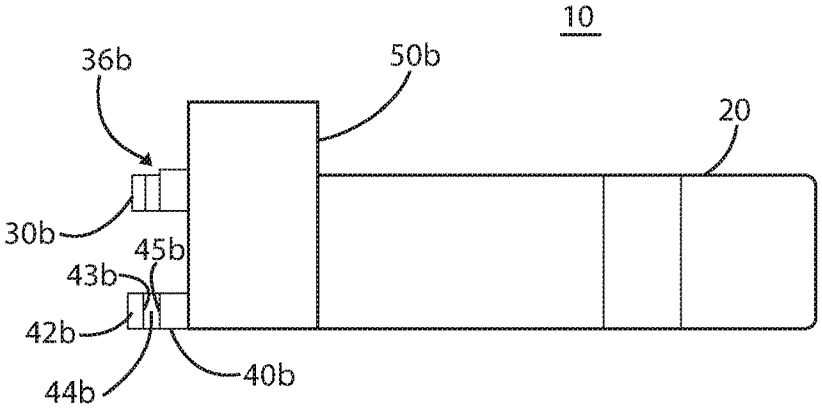
FIG. 4 shows a side view of the exemplary network device installation tool of FIG. 1.
Figure 3:
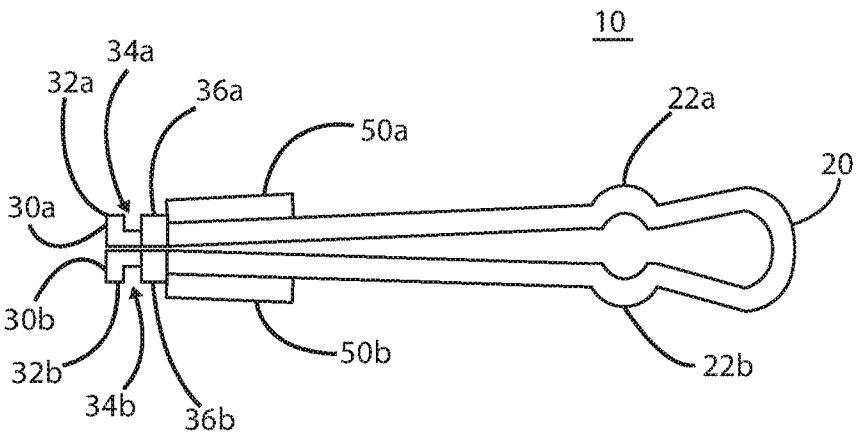
FIG. 3 shows another perspective view of the exemplary network device installation tool of FIG. 1.

The body 20 may provide a base to which the lip locks 30*a*, 30*b*, 40*a* and 40*b* are attached so that the lip locks 30*a*, 30*b*, 40*a* and 40*b* may be inserted into apertures in the rack as described below. In addition, the body 20 also may act as a spring to bias lip locks 30*a*, 30*b*, 40*a* and 40*b* so that the outer lips 32*a*, 32*b*, 42*a* and 42*b* wrap around the rack frame during installation. In the illustrated embodiment, the body 20 has an arch shape having legs 24*a* and 24*b*. The tool 10 may act as a V-spring, similar to a tweezer, and two spring elements 22*a* and 22*b* that comprise angled notched portions of the body 20 may assist the flexibility of the body 20. The body 20 may have a resting position as shown in FIGS. 1 and 2*a*-*b*. The body 20 may be compressed so that legs 24*a* and 24*b* come together as shown in FIG. 3. Other configurations, such as more or less notched portion spring elements 22*a* and 22*b* may be provided in the body 20, or other spring elements, such as a torsion spring or the like, may be attached to the body 20 to achieve similar functionality.

Because the body 20 may act as a handle by which the technician may grab the tool 10 and squeeze the tool 10 during installation, the body 20 may have a length between about 2 inches and about 8 inches, preferably between about 3 inches and about 6 inches, and even more preferably between about 3 and ½ inches and about 5 inches. In the illustrated embodiment, the body 20 is about 4 inches long.

1.2 Exemplary Upper Lip Locks 30*a* and 30*b*

Figure 5:
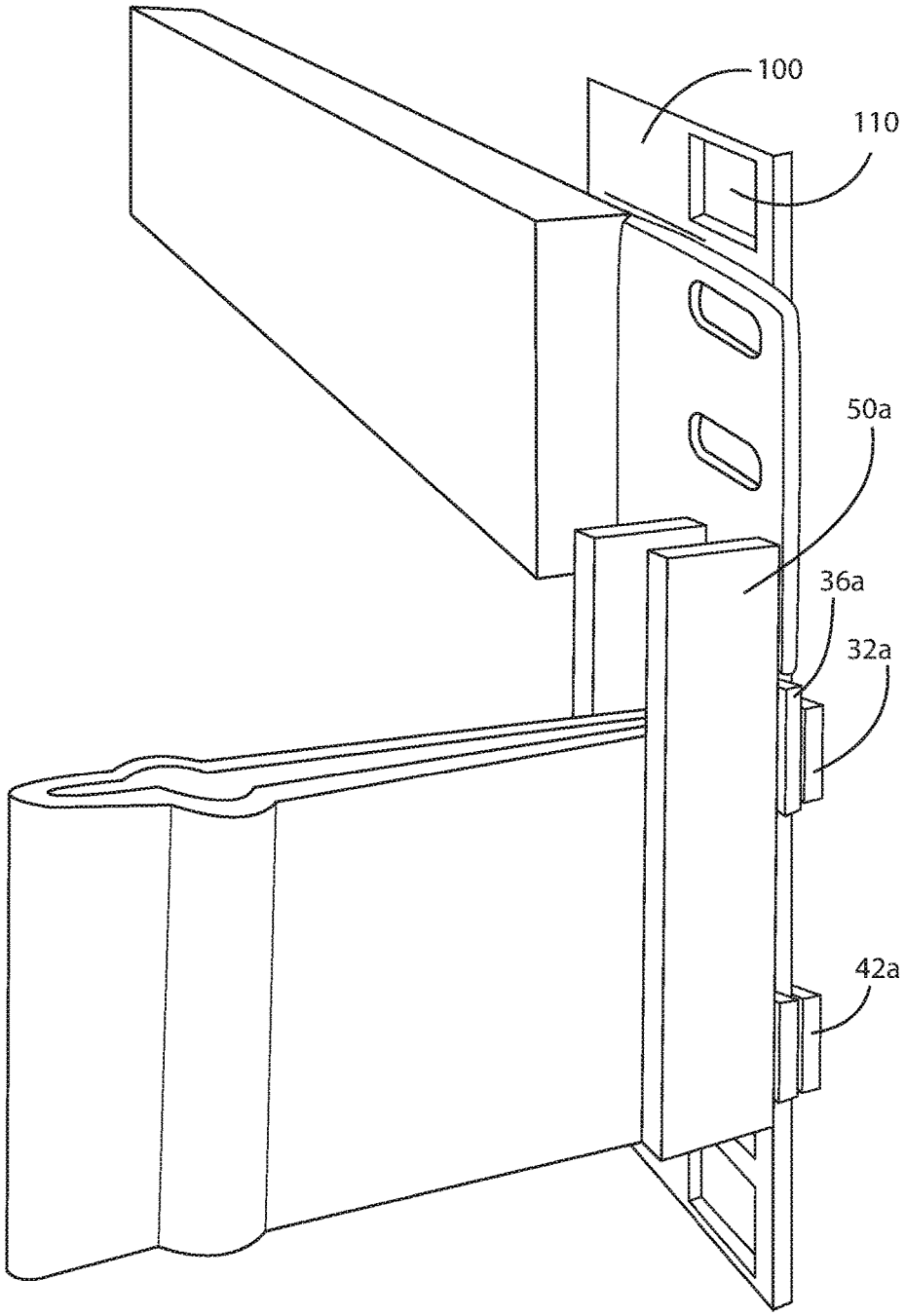
FIG. 5 shows a perspective view of the exemplary network device installation tool of FIG. 1 installed in a network device rack.

The upper tool lip locks 30*a* and 30*b* may be shaped to secure the tool 10 to the rack. In the illustrated embodiment, the upper tool lip locks 30*a* and 30*b* each include a U-shaped portion defined by an outer lip 32*a* having an surface 33*a*, recessed portion 34*a* and surface 35*a*. Each upper lip lock 30*a* and 30*b* may be attached to a corresponding leg 24*a* and 24*b* of the body so that, when the body 20 of the tool 10 is squeezed together, the upper lip locks 30*a* and 30*b* come together to form a square that fits inside a single square aperture on the rack. Upon release, the upper lip locks 30*a* and 30*b* may lock in place by securing the rack frame in the space defined by surfaces 33*a* and 33*b*, recessed portions 34*a* and 34*b*, and surfaces 35*a* and 35*b*, as shown in FIG. 5. This locking action holds the tool 10 in place.

In some embodiments, the upper lip locks 30*a* and 30*b* may be dimensioned so as to fit snugly into the square apertures provided in the rack. As known, the EIA 310 standard specifies that a rack unit includes square apertures of the rack that are 0.375 inch by 0.375 inch aligned in sets of three apertures spaced off center-to-center by 0.625 inch with the sets spaced by 0.5 inch center-to-center from adjacent apertures. Accordingly, the height of the outer lips 32*a* and 32*b*, which may also be the same as the height of surfaces 33*a* and 33*b*, may be between about 0.340 inches and about 0.374 inches, preferably between about 0.350 inches and about 0.365 inches, even more preferably between about 0.357 inches and about 0.361 inches. In the illustrated embodiment, the height of the outer lips 32*a* and 32*b* is about 0.359 inch.

The width of the outer lips 32*a* and 32*b* may be dimensioned so that the two lips 32*a* and 32*b* may fit snugly into the 0.375 inch square apertures provided in the rack when the body 20 is compressed. Accordingly, the width of the outer lips 32*a* and 32*b* may be between about 0.340 inch and about 0.374 inch, preferably between about 0.350 inch and about 0.365 inch, even more preferably between about 0.357 inch and about 0.361 inch. In the illustrated embodiment, the width of the outer lips 32*a* and 32*b* is about 0.170 inch.

In some embodiments, the recessed portions 34*a* and 34*b* may allow may the upper lip locks 30*a* and 30*b* to fit snugly around the rack frame. Thus, the recessed channels 34*a* and 34*b* may have a depth at least as long as the rack frame. As an example, for a rack frame having a thickness of about 0.1046 inch, the depth of the recessed portions 34*a* and 34*b* may be between about 0.1047 inch and about 0.2 inch, preferably between about 0.105 inch and about 0.150 inch, even more preferably between about 0.108 inch and about 0.125 inch. In the illustrated embodiment, the depth of the recessed portions 34*a* and 34*b* is about 0.110 inch.

The upper lip locks 30*a* and 30*b* also may include device levelers 36*a* and 36*b*. The device levelers 36*a* and 36*b* may provide surfaces 37*a* and 37*b* for the to-be-installed network device to be to rest atop such that the ears of the to-be-installed network device are properly aligned to the apertures of the intended rack unit. Accordingly, the device levelers 36*a* and 36*b* may be positioned on the tool 10 so that their upper surfaces 37*a* and 37*b* sit between about between about 0.055 inch and about 0.070 inch above the upper edge of the highest aperture of the rack unit into which the tool 10 is inserted, and preferably between about 0.060 inch and about 0.065 inch above the upper edge of the highest aperture of the rack unit into which the tool 10 is inserted. In the illustrated embodiment, the device levelers 36*a* and 36*b* are positioned so that their upper surfaces 37*a* and 37*b* sit about 0.063 inch above the upper edge of the highest aperture of the rack unit into which the tool 10 is inserted.

The device levelers 36*a* and 36*b* may include surfaces 35*a* and 35*b* that complete the U-shaped portions of the upper lip locks 30*a* and 30*b* that are proximate and/or abut the rack frame when the tool 10 is fully inserted into the rack apertures. In the illustrated embodiment, the height of surfaces 45*a* and 45*b* may coincide with the height of surfaces 33*a* and 33*b* of the outer lips 32*a* and 32*b* plus the height of the device levelers 36*a* and 36*b*. Because these surfaces 35*a* and 35*b* do not need to fit through the rack apertures, other dimensions also may be used.

Other dimensions also may be used for the various components of the upper lip locks 30*a* and 30*b*. Other locking mechanisms also may be used to secure the tool 10 to the rack in a similar fashion.

1.3 Exemplary Lower Tool Lip Locks 40*a* and 40*b*

The lower lip locks 40*a* and 40*b* may have similar functionality and form to the upper lip locks 30*a* and 30*b*. For example, the lower lip locks 40*a* and 40*b* each may include a U-shaped portion defined by outer lips 42*a* and 42*b* that include surfaces 43*a* and 43*b*, recessed portions 44*a* and 44*b*, and surfaces 45*a* and 45*b*. Each lower lip lock 40*a* and 40*b* may be attached to a respective leg 24*a* and 24*b* of the body. Because the to-be-installed network device will not rest upon the upper surface of the lower lip locks 40*a* and 40*b*, device levelers 36*a* and 36*b* are not required.

The lower lip locks 40*a* and 40*b* may include surfaces 45*a* and 45*b* that complete the U-shaped portions of the lower lip locks 40*a* and 40*b* that are proximate and/or abut the rack frame when the tool 10 is fully inserted into the rack apertures. In the illustrated embodiment, the height of surfaces 45*a* and 45*b* may coincide with the height of surfaces 43*a* and 43*b* of the outer lips 42*a* and 42*b*. Because these surfaces 45*a* and 45*b* do not need to fit through the rack apertures, other dimensions also may be used.

In the illustrated embodiments, upper lip locks 30*a* and 30*b* and lower lip locks 40*a* and 40*b* are provided to fit into the upper and lower apertures of a rack unit. Other configurations also may be used. For example, any number of lip locks may be provided to fit into any one or more of the apertures, such as a single lip lock for a single aperture or three sets of two lip locks for each aperture in a rack unit. Additionally, or alternatively, the tool 10 may include lip locks or other locking mechanism that span multiple rack units.

1.4 Exemplary Device Tilt Locks 50*a* and 50*b*

The tool 10 also may include one or more device tilt locks 50*a* and 50*b* to lock the to-be-installed network device rack ear between the cabinet railing and the tool 10. In other words, the device tilt locks 50*a* and 50*b* may physically hold the to-be-installed network device in place. Accordingly, the upper portion of the device tilt locks 50*a* and 50*b* may extend vertically into the space in front of the intended rack unit. For example, the device tilt locks 50*a* and 50*b* may extend vertically into the space in front of the intended rack unit by between about 10% of the space (about 0.175 inches) and about 100% (about 1.75 inches) of the space, preferably by between about 25% of the space (about 0.438 inches) and about 66% of the space (about 1.155 inches), and even more by preferably between about 33% of the space (about 0.578 inches) and about 50% of the space (about 0.875 inches). In the illustrated embodiment, the device levelers 50*a* and 50*b* extend into the space by about 40% of the space (about 0.700 inches).

2.0 Exemplary Device Installation Process

Figure 6:
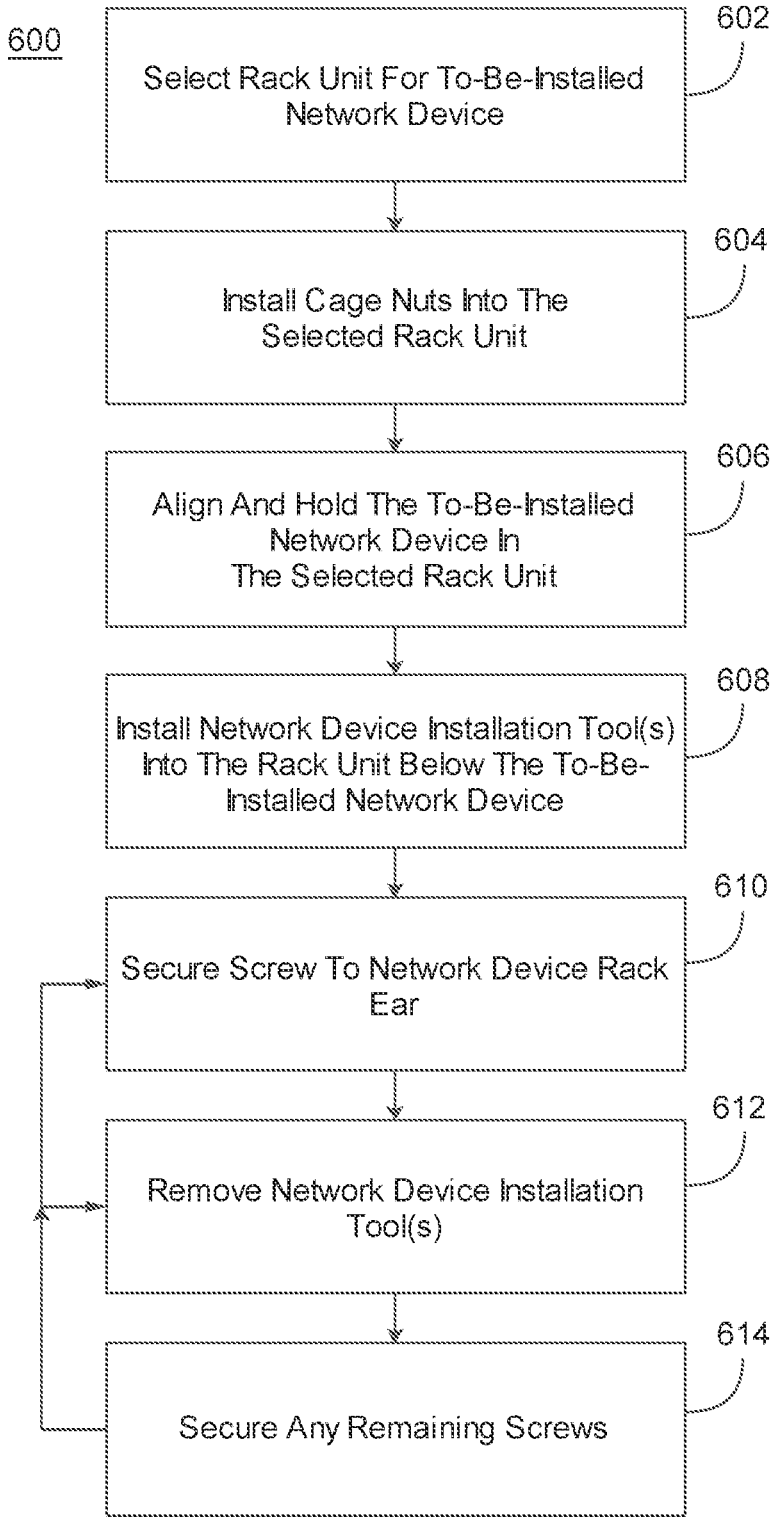
FIG. 6 shows a flow chart of an exemplary network device installation process using one or more of the exemplary network device installation tools of FIG. 1.

Referring to Figures band 7*a-e*, a flow chart of an exemplary network device installation process 600 using one or more of the exemplary network device installation tools (FIG. 6) and front views of an exemplary network device rack during an exemplary network device installation process using two of the exemplary network device installation tool (FIGS. 7*a-e*) are shown.

Figure 7A:
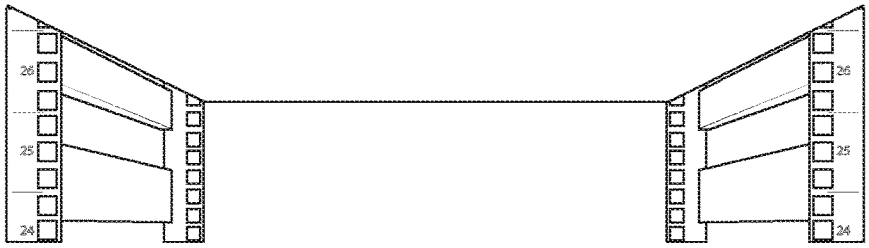
FIGS. 7*a-e* show front views of an exemplary network device rack during an exemplary network device installation process using two of the exemplary network device installation tools of FIG. 1.
Figure 7B:
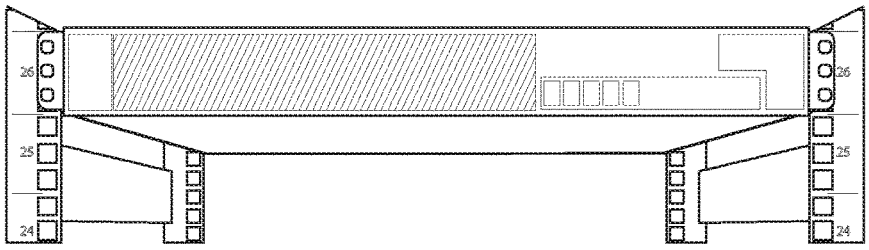

Initially, the technician may select a rack unit for the to-be-installed network device at step 602 and install cage nuts in the selected rack unit at step 604. This is shown in FIG. 7*a*, which depicts rack with several empty rack units. Next, the technician may carry/place the to-be-installed network device and align and hold the device in the selected rack unit at step 606. This is shown in FIG. 7*b*, which depicts the to-be-installed network device in the selected rack unit.

Figure 7C:
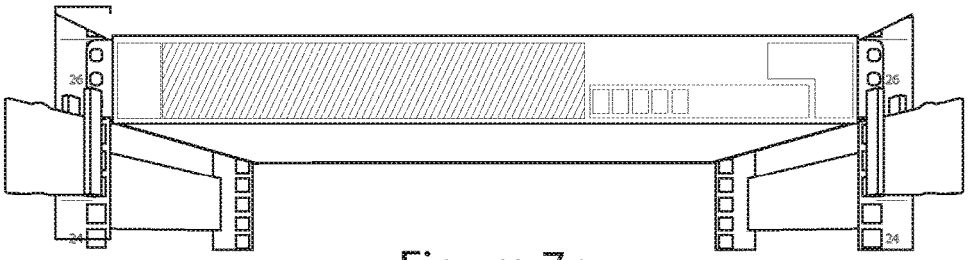

Next, the technician may insert a network device installation tool 10 into a post of the rack in the rack unit immediately below the selected rack unit at step 608. For example, using the tool 10 as shown in FIG. 1, the technician may squeeze the body 20, insert the lip locks 30*a*, 30*b*, 40*a* and 40*b* into the upper and lower apertures in the rack unit below the selected rack unit, and release the body 20, locking the tool 10 in place and ensuring that the tool 10 covers the rack ear of the network device. This step may be repeated for each tool 10 that is required for the installation. This is shown in FIG. 7*c*, which depicts a rack with a network device resting atop two tools 10.

Figure 7D:
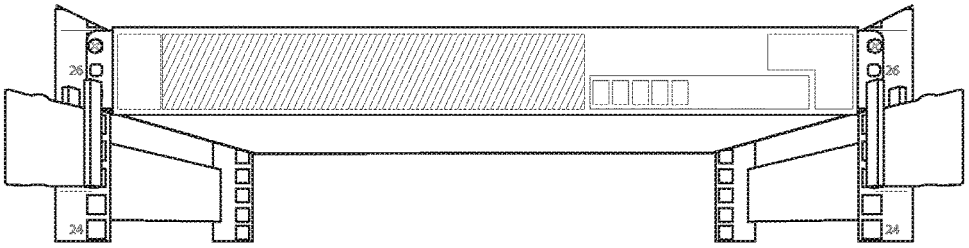

Once the tool 10 is inserted into the rack, the technician may secure at least one screw to the device at step 610. For example, the technician may secure a screw in the upper aperture of the rack ear. Once the at least one screw is secured, the technician may remove the tool 10 from the rack at step 612. This process may then be repeated for each tool 10 being used in the installation process. This is shown in FIG. 7*d*, which depicts a rack with a network device resting atop two tools 10 and a single screw in each rack ear of the network device.

Figure 7E:
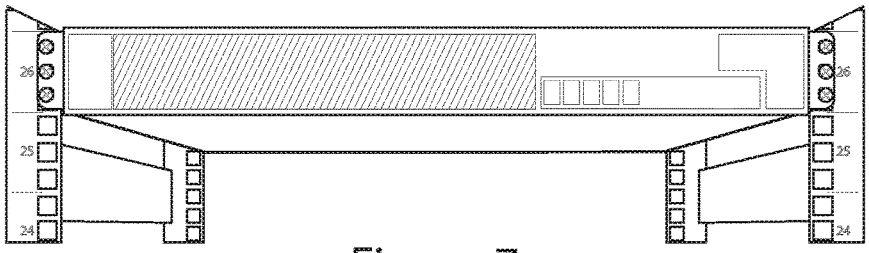

Once the tools 10 have been removed, the technician may secure any remaining screws at step 614. Alternatively, or additionally, the technician may secure all of the screws in given rack ear before removing the tool 10 from that side, may secure all the screws in a given rack ear before securing any screws to any other ears, or the like. This is shown in FIG. 7*e*, which depicts a fully installed network device.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A tool for assisting in the installation of a device in a rack including an aperture having a width, the tool comprising:

a body having an arch shape, the body including a first leg and a second leg;

a tilt lock attached to the body, the tilt lock comprising an elongated element extending past at least one side of the body proximate to a leveler configured to support the device; and one or more lips each attached to a corresponding leg, each lip extending laterally outwardly from the body such that a combined width of the one or more lips is less than the width of the aperture.

2. The tool of claim 1, where the body acts as a V-spring.

3. The tool of claim 1, where the leveler includes an upper surface that, when the tool is positioned in a rack unit, rests between about 0.055 inch and about 0.070 inch above an upper edge of an upper aperture of the rack unit.

4. The tool of claim 1, where each lip has a height between about 0.340 inches and about 0.374 inches and widths between about 0.340 inch and about 0.374 inch.

5. The tool of claim 1, where the tilt lock extends into a space in front of a rack unit above the tool when the tool is positioned in a second rack unit.

6. The tool of claim 5, where the tilt lock extends into the space in front of a rack unit above the tool by between about 25% of the space and about 66% of the space.

7. A tool for assisting in the installation of a device in a rack including a plurality of apertures, the device including at least one rack ear, the tool comprising:

a body, the body having a first neutral position, a first lip lock attached to a first portion of the body, the first lip lock including an outer lip, a second lip lock attached to a second portion of the body, the second lip lock including an outer lip;

a leveler attached to the body, the leveler including an upper surface for receiving the rack ear of the device; and a tilt lock attached to the body, the tilt lock comprising an elongated element extending past at least one side of the body proximate to the leveler;

where the body is movable to a second biased position wherein the outer lip of the first lip lock and the outer lip of the second lip lock are positioned to fit through a selected one of the plurality of apertures of the server rack.

8. The tool of claim 7, where the outer lips of the first and second lip locks have heights between about 0.340 inches and about 0.374 inches and widths between about 0.340 inch and about 0.374 inch.

9. The tool of claim 7, where the tilt lock extends into the space in front of a rack unit above the tool by between about 25% of the space and about 66% of the space.

10. The tool of claim 7, where the device leveler includes an upper surface that, when the tool is positioned in a rack unit of the server, rests between about 0.055 inch and about 0.070 inch above the upper edge of the upper aperture of the rack unit.

11. The tool of claim 1, where the first lip lock includes a recessed portion for receiving a first portion of the rack and the second lip lock includes a recessed portion for receiving a second portion of the rack.

12. The tool of claim 7, where the body comprises a V-spring.

13. The tool of claim 7, where the body include two notched spring portions.

14. The tool of claim 7, where the selected aperture and the second aperture are part of a rack unit of the server rack, the rack unit including an upper aperture, a middle aperture and a lower aperture, and where the selected aperture is the upper aperture and the second aperture is the lower aperture.

15. A tool for assisting in the installation of a device in a rack including a plurality of apertures, the device including at least one rack ear, the tool comprising:

a body, the body comprising a V-spring biased in a first position, a first lip lock attached to a first portion of the body, the first lip lock including an outer lip and a recessed portion for receiving a first portion of the rack, a second lip lock attached to a second portion of the body, the second lip lock including an outer lip and a recessed portion for receiving a second portion of the rack;

a third lip lock attached to a third portion of the body, the third lip lock including an outer lip and a recessed portion for receiving a third portion of the rack, a fourth lip lock attached to a fourth portion of the body, the fourth lip lock including an outer lip and a recessed portion for receiving a fourth portion of the rack;

a leveler attached to the body, the leveler including an upper surface for receiving the rack ear of the device; and a tilt lock attached to the body, the tilt lock comprising a elongated element extending past at least one side of the body proximate o a device leveler configured to support the device, where the body is movable to a second position wherein the outer lip of the first lip lock and the outer lip of the second lip lock are positioned to fit through the same aperture of the rack, where the outer lip of the third lip lock and the outer lip of the fourth lip lock are positioned to fit through a second aperture of the rack when the tool is in the second position, where the upper surface of the leveler, when the tool is positioned in a rack unit, rests between about 0.055 inch and about 0.070 inch above the upper edge of the upper aperture of the rack unit, where the outer lips of the first, second, third and fourth lip locks have heights between about 0.340 inches and about 0.374 inches and widths between about 0.340 inch and about 0.374 inch.

16. The tool of claim 15, where the tilt lock extends into a space in front of a rack unit above the tool when the tool is positioned in a second rack unit by between about 25% of the space and about 66% of the space.

17. The tool of claim 1, where the one or more lips are adapted to couple to corresponding apertures in the rack.

18. The tool of claim 1, where each lip is attached to a terminal end of the corresponding leg.

19. The tool of claim 1, where the elongated element is positioned flush against a rack ear of the device during installation in the rack.

20. The tool of claim 1, where the elongated element is rectangular shaped.

* * * * *